US008139815B2

(12) United States Patent
Yeom

(10) Patent No.: US 8,139,815 B2
(45) Date of Patent: Mar. 20, 2012

(54) DAMPER OF RECTANGULAR-SHAPED SLIM SPEAKER

(75) Inventor: Dae Shik Yeom, Namyangjoo (KR)

(73) Assignee: Korea Toptone Co., Ltd., Kyonggi-do (KR)

( * ) Notice: Subject to any disclaimer, the term of this patent is extended or adjusted under 35 U.S.C. 154(b) by 1272 days.

(21) Appl. No.: 11/788,272

(22) Filed: Apr. 19, 2007

(65) Prior Publication Data

US 2007/0258615 A1 Nov. 8, 2007

(30) Foreign Application Priority Data

Apr. 19, 2006 (KR) ..... 10-2006-0035506

(51) Int. Cl.
*H04R 9/06* (2006.01)
*H04R 11/02* (2006.01)
*H04R 1/00* (2006.01)

(52) U.S. Cl. ..... 381/413; 381/412

(58) Field of Classification Search ..... 381/398, 381/403–405, 407, 431, 413, 412; 181/171, 181/172

See application file for complete search history.

(56) References Cited

U.S. PATENT DOCUMENTS

| | | | | |
|---|---|---|---|---|
| 5,790,682 | A * | 8/1998 | Hachiya et al. | 381/405 |
| 5,862,242 | A | 1/1999 | Takewa et al. | |
| 6,973,194 | B2 * | 12/2005 | Iwasa et al. | 381/412 |
| 2004/0086149 | A1 * | 5/2004 | Johannsen et al. | 381/412 |
| 2009/0323990 | A1 * | 12/2009 | Kim et al. | 381/191 |

* cited by examiner

*Primary Examiner* — Davetta W Goins
*Assistant Examiner* — Phan Le
(74) *Attorney, Agent, or Firm* — Jordan and Hamburg LLP

(57) ABSTRACT

The present invention relates to a damper of a rectangular-shaped slim speaker that is capable of preventing a vibration plate having an entire outer appearance of a slim oval/track-like shape extended to any one side thereof from being moved in forward and backward directions. The damper of a rectangular-shaped slim speaker includes: fixed end portions formed on either end thereof, respectively, to face each other in a vertical direction; support plate portions each extended backwardly from the fixed end portions; and an elastic portion extended backwardly from the support plate portions, wherein the fixed end portions, the support plate portions, and the elastic portion are formed integrally as an injection molded plastic product.

6 Claims, 5 Drawing Sheets

DAMPER OF RECTANGULAR-SHAPED SLIM SPEAKER

BACKGROUND OF THE INVENTION

1. Field of the Invention

The present invention relates to a speaker, and more particularly, to a damper of a rectangular-shaped slim speaker that is capable of preventing a vibration plate having an entire outer appearance of a slim oval/track-like shape extended to any one side thereof from being moved in forward and backward directions.

2. Background of the Related Art

According to a general speaker structure, current of a power amplifier flows through the voice coil wound around a voice coil former of a speaker unit, and at which time the flowing current generates a magnetic field expanding and contracting at the same frequency as the audio signal around the voice coil. In this case, since the voice coil is caught in the magnetic field generated by the magnet in the speaker unit, the voice coil former having the voice coil wound therearound is moved in forward and backward directions by means of the cooperative actions with the magnetic field generated from the voice coil to correspond to the generated magnetic field.

At this time, as the voice coil former has been coupled to a vibration plate, the vibration plate pushes air while being moved in the forward and backward directions together with the voice coil former, thereby generating sound due to the vibration of the air. In this case, if the vibration is generated unstably, the generated sound may be broken up or distorted. To prevent such problems from occurring in the speaker, thus, the voice coil former having the voice coil that serves to move the vibration plate in the forward and backward directions is connected to the speaker unit by means of a damper, so as to control the width of the vibration of the vibration plate.

If the vibration plate is formed in a round shape, however, the damper also has a round shape such that the amplitudes of the vibration plate can be uniformly maintained, thereby stably controlling the width of the vibration. Contrarily, if the vibration plate is formed in a slim rectangular shape, as shown in FIG. 5, the voice coil former connected with the vibration plate also has the slim rectangular shape, and even the damper also has the slim rectangular shape. Such a rectangular-shaped damper has the front and back widths larger than the left and right widths thereof, such that there occurs a defect that the width of the vibration is not uniformly generated.

To overcome the defect occurring in the rectangular shape of damper, recently, there has been proposed another type of conventional damper of the rectangular-shaped slim speaker, as shown in FIG. 6, wherein a plastic film or sheet having a given strength corresponding to the vibration of the vibration plate is forcedly bent and fixed to the both end portions of the rectangular voice coil former and the speaker unit, thereby making the width of vibration of the rectangular voice coil former stably maintained. However, in case where the damper is molded to a shape of plastic film or sheet, it does not have uniform thickness or smoothness, such that it cannot maintain the upper and lower amplitudes uniformly in response to the vibration of the vibration plate, thereby causing the distortion of the sound generated from the vibration plate. Furthermore, the plastic film or sheet has a force of returning to its original shape from its forced-bending state, thereby making it difficult to uniformly maintain the upper and lower amplitudes of the vibration plate, and additionally, the elasticity of the plastic film or sheet is decreased according to the repeated use. Thus, the upper and lower amplitudes of the vibration plate are not moved in a vertical direction, but moved in left and right directions, such that undesirably, the distortion of the sound occurs.

SUMMARY OF THE INVENTION

Accordingly, the present invention has been made in view of the above-mentioned problems occurring in the prior art, and it is an object of the present invention to provide a damper of a rectangular-shaped slim speaker that is an injection molded plastic product having a bent shape, thereby preventing the distortion of the amplitudes of a vibration plate.

It is another object of the present invention to provide a damper of a rectangular-shaped slim speaker that is an injection molded plastic product having a bent shape, thereby providing ease of assembly.

To accomplish the above objects, according to the present invention, there is provided a damper of a rectangular-shaped slim speaker including: fixed end portions formed on either end thereof, respectively, to face each other in a vertical direction; support plate portions each extended backwardly from the fixed end portions; and an elastic portion extended backwardly from the support plate portions, wherein the fixed end portions, the support plate portions, and the elastic portion are formed integrally as an injection molded plastic product.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
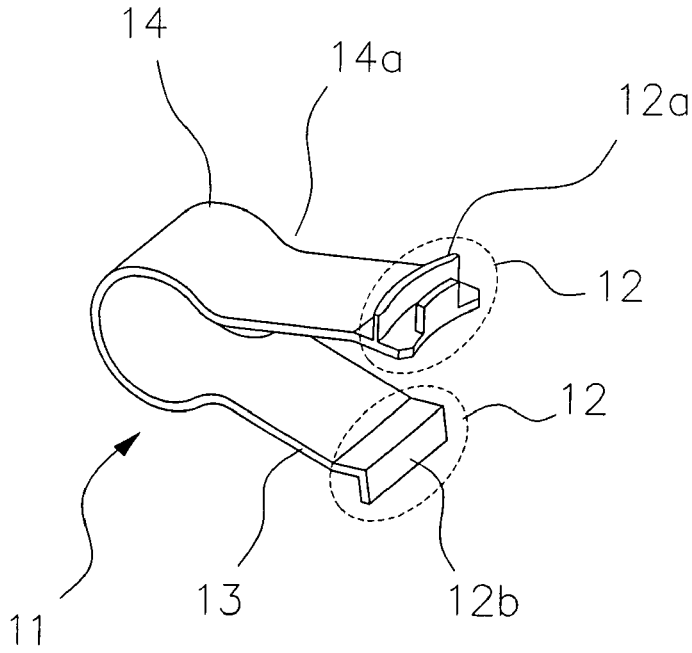
FIG. 1 is a perspective view showing an outer appearance of a damper of a rectangular-shaped slim speaker according to the present invention.
Figure 2:
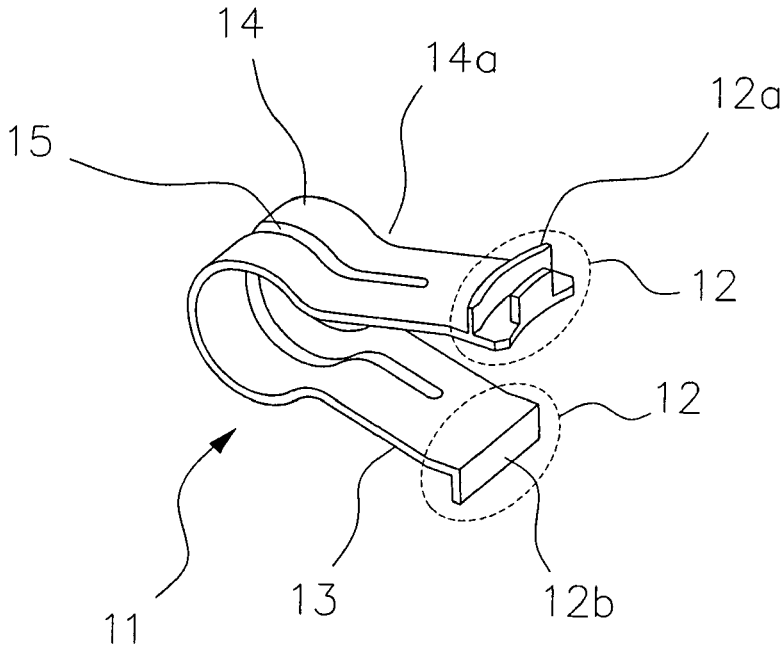
FIG. 2 is a perspective view showing another outer appearance of the damper according to the present invention.
Figure 3:
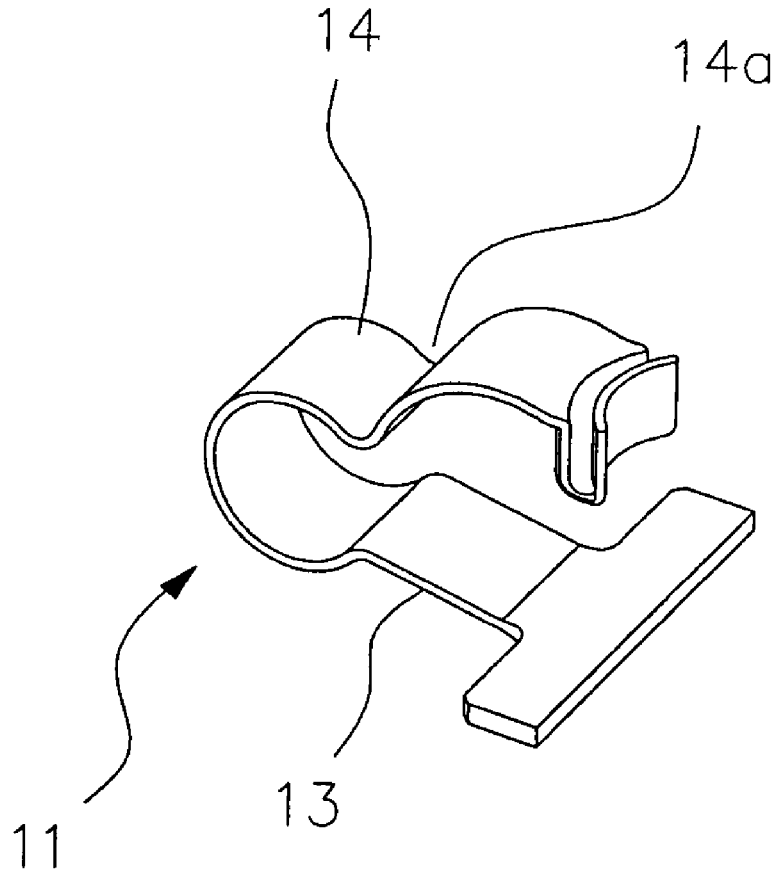
FIG. 3 is a perspective view showing another example of the fixed end portions of the damper according to the present invention.
Figure 4:
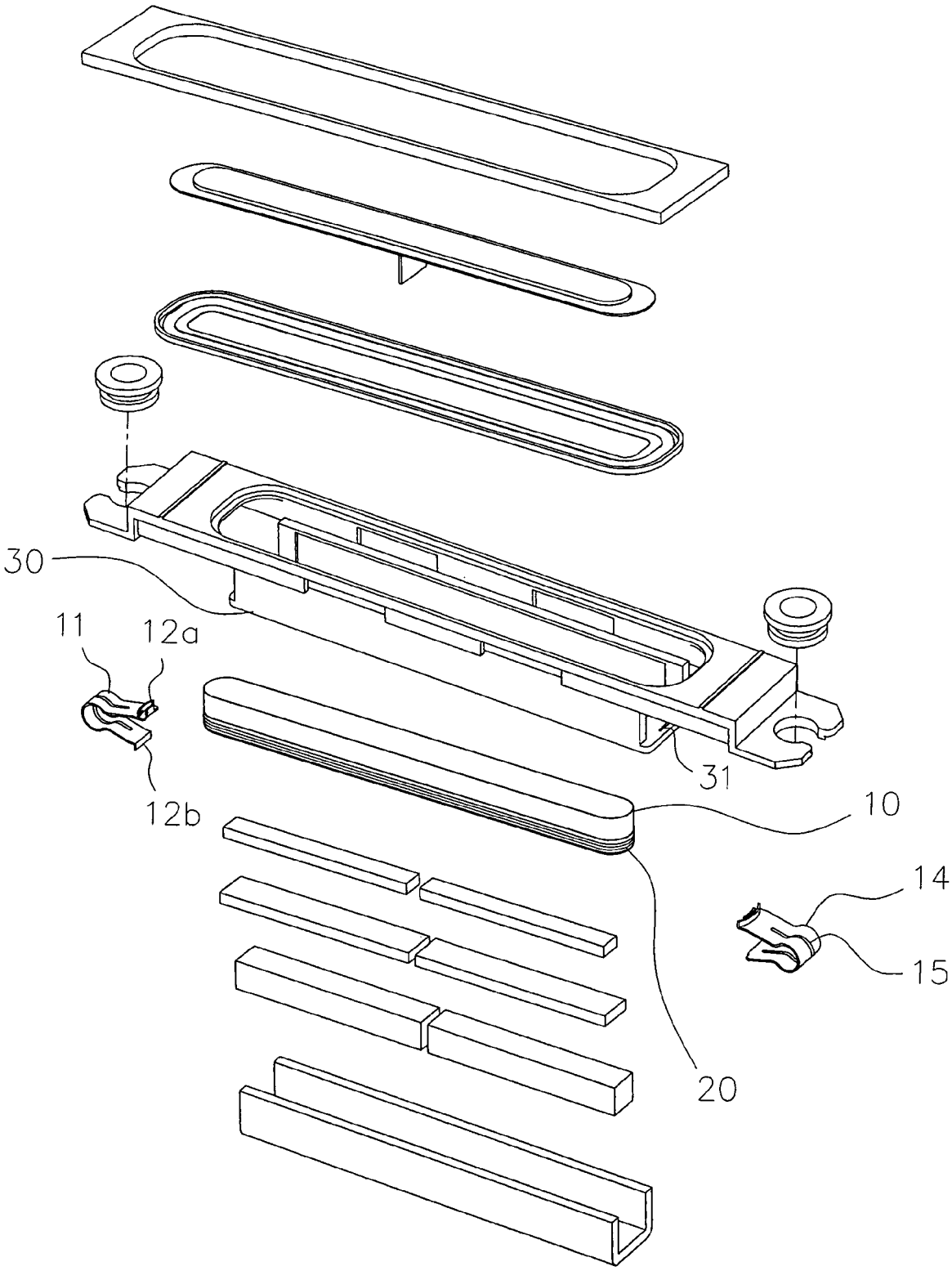
FIG. 4*a* is an assembling view showing the speaker unit embodied according to the principles of the present invention.
FIG. 4*b* is a perspective view showing the assembled state of the speaker unit embodied according to the principles of the present invention.
Figure 4A:
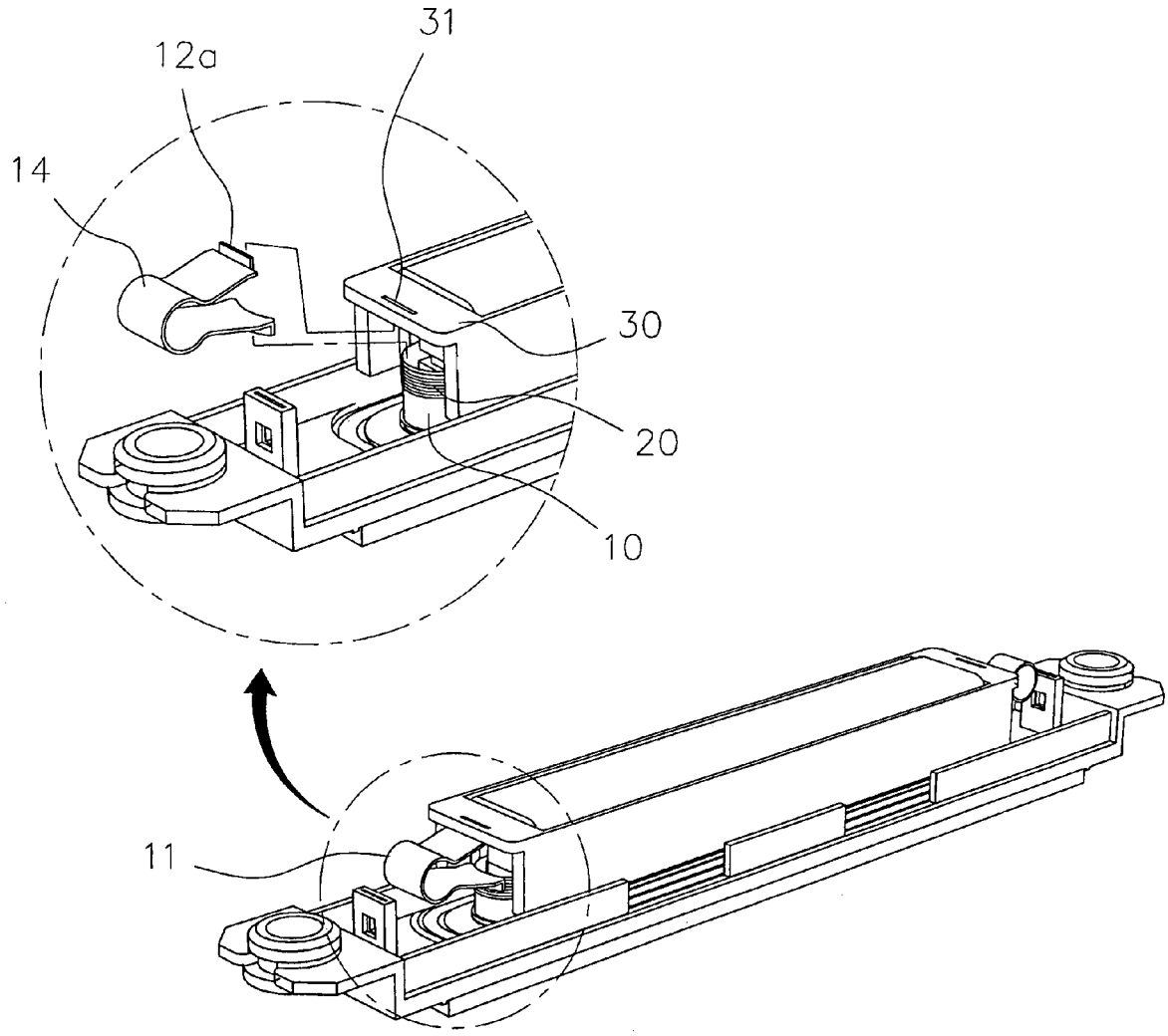
Figure 5:
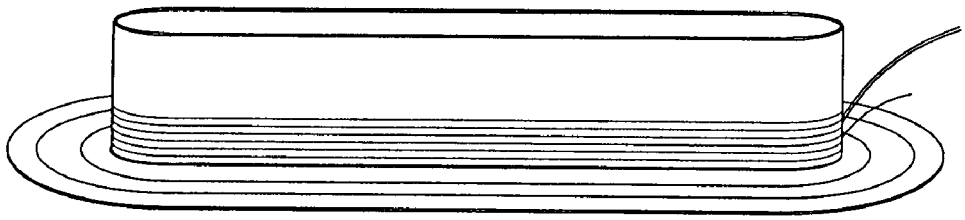
FIG. 5 is a view showing the structure of the damper adopted in a conventional rectangular-shaped slim speaker.
Figure 6:
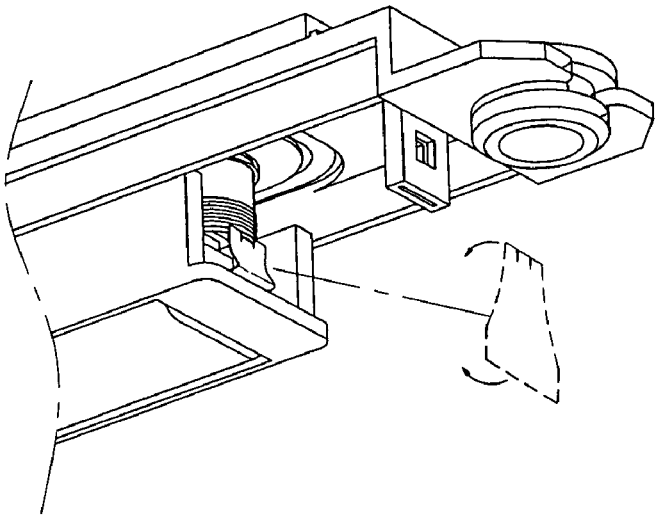
FIG. 6 is a view showing the structure of the damper adopted in another type of conventional rectangular-shaped slim speaker.

Hereinafter, an explanation of a damper of a rectangular-shaped slim speaker according to the present invention will be given with reference to the attached drawings.

First, according to the basic structure of the present invention, a vibration plate has an entire structure in an elongated shape to any one side thereof, and a voice coil former serving to actuate the vibration plate is also elongated to any one side thereof. Also, a damper serving to control the upper and lower vibration of the vibration plate is formed of an injection molded plastic product having a bent shape, thereby controlling the upper and lower amplitudes. Further, the molded product is provided with a fixed end portion formed at the both end portions thereof, respectively, in such a manner as to be easily fixed to the positions corresponding thereto, with a support plate portion extended to a predetermined length backwardly from each of the fixed end portions, and with an elastic portion extended in a curved shape backwardly from the upper and lower support plate portions.

Now, an explanation on the preferred embodiments of the present invention will be in detail given.

First, a damper 11 of the present invention includes fixed end portions 12 adapted to be coupled to a voice coil former 10 and a speaker unit frame 30, support plate portions 13 extended backwardly from the fixed end portions 12, and an elastic portion 14 extended backwardly from the support plate portions 13 in such a manner as to dispose the support plate portions 13 in an upper and lower position relation to each other. The above-mentioned structure is formed integrally as injection molded plastic product.

According to the damper structure of this invention, as shown in FIG. 1, the damper 11 has the fixed end portions 12 formed on either end thereof, one fixed end portion 12 having a diaphragm 12*a* adapted to be fixedly inserted into the voice coil former 10 having a curved face on the both sides in a state where a voice coil 20 is wound therearound, and the other fixed end portion 12 having an insertion protrusion 12*b* adapted to be fixedly inserted into a coupling slot 31 of the speaker unit frame 30.

Further, the damper of this invention includes the support plate portion 13 extended to a predetermined length backwardly from each of the fixed end portions 12 and the elastic portion 14 extended backwardly from the support plate portions 13.

At this time, the support plate portions 14 are formed inclined with respect to the elastic portion 14 in a state of being bent at a given angle with respect to the fixed end portions 12. As a result, when the fixed end portions 12 are fixed to the voice coil former 10 and the speaker unit frame 30, they have given inclination by the inclination angles of the support plate portions 13, such that they can be coupled to the voice coil former 10 and the speaker unit frame 30, without having any pressure.

The elastic portion 14 that is extended backwardly from the support plate portions 13 has a bent portion 14*a* formed bent at a predetermined angle, such that the elastic portion 14 has a curved shape, and preferably, the elastic portion 14 has a generally round shape.

Moreover, an incised portion 15 is formed longitudinally along the center portion of the elastic portion 14, the incised portion 15 being adapted to prevent the residual stress generated upon the upper and lower operations of the support plate portion 13 from being applied thereto, thereby maintaining gentle elastic force thereon.

Also, one fixed end portion of the fixed end portions 12 respectively formed on either end of the damper is formed to have a more extended length than the other fixed end portion, and thus, if the voice coil former 10 is moved in upper and lower directions, the relatively more extended one side fixed end portion 12 serves to prevent the voice coil former 10 from being pulled to the left and right sides thereof, such that while the voice coil former 10 is being moved in the upper and lower directions at the same amplitudes, it can be moved vertically in an accurate manner. The accurateness of the upper and lower movements of the voice coil former 10 is ensured by means of the elastic portion 14 being in a curved shape.

In a case where the vibration plate 40 is moved in the upper and lower directions, therefore, it is possible to move the voice coil former 10 in the upper and lower directions in an accurate manner by means of the damper 11, without any resistance.

As set forth in the foregoing, in the damper of the rectangular-shaped slim speaker according to the present invention, in a case where the rectangular vibration plate is moved in forward and backward directions by means of the rectangular voice coil former, the damper is formed only on the both end portions of the voice coil former, such that the voice coil former can be moved in the forward and backward directions in an accurate manner, without any interference of the damper. Additionally, the damper itself is formed as an injection molded product, such that it can maintain uniform thickness and smoothness, thereby preventing the twisting or bending on the surface thereof. Thus, even though the vibration plate is rectangular, no bending occurs on the vibration plate.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A damper of a rectangular-shaped slim speaker comprising:

fixed end portions formed on either end thereof, respectively, to face each other in a vertical direction;

support plate portions each extended backwardly from the fixed end portions; and an elastic portion extended backwardly from the support plate portions, wherein the fixed end portions, the support plate portions, and the elastic portion are formed integrally as an injection molded plastic product.

2. The damper of a rectangular-shaped slim speaker according to claim 1, wherein one facing fixed end portions is formed to have a more extended length than the other side fixed end portion.

3. The damper of a rectangular-shaped slim speaker according to claim 1, wherein one side of the facing fixed end portions has a diaphragm adapted to be fixedly inserted into a voice coil former, and the other of the facing fixed end portions has an insertion protrusion adapted to be fixedly inserted into a speaker unit frame.

4. The damper of a rectangular-shaped slim speaker according to claim 1, wherein the support plate portions are formed inclined with respect to the elastic portion in a state of being bent at a given angle with respect to the fixed end portions.

5. The damper of a rectangular-shaped slim speaker according to claim 1, wherein the elastic portion extended backwardly from the support plate portions has a bent portion formed bent to a predetermined angle, such that the elastic portion has a curved shape.

6. The damper of a rectangular-shaped slim speaker according to claim 5, wherein the elastic portion has an incised portion formed longitudinally along a center portion thereof.

* * * * *